US008782952B2

(12) United States Patent
Alsadah

(10) Patent No.: US 8,782,952 B2
(45) Date of Patent: Jul. 22, 2014

(54) EMERGENCY VEHICLE WINDOW OPENER

(71) Applicant: Hashim Mohammed Alsadah, Toledo, OH (US)

(72) Inventor: Hashim Mohammed Alsadah, Toledo, OH (US)

( * ) Notice: Subject to any disclaimer, the term of this patent is extended or adjusted under 35 U.S.C. 154(b) by 0 days.

(21) Appl. No.: 13/724,442

(22) Filed: Dec. 21, 2012

(65) Prior Publication Data

US 2014/0173985 A1 Jun. 26, 2014

(51) Int. Cl.
*E05F 15/16* (2006.01)

(52) U.S. Cl.
USPC ..... 49/139; 49/141

(58) Field of Classification Search
USPC ..... 49/139, 140, 141, 348, 349, 350, 351, 49/352, 502; 296/146.2, 146.3, 146.1, 296/146.16; 318/266, 466; 307/9.1, 10.1; 74/625
See application file for complete search history.

(56) References Cited

U.S. PATENT DOCUMENTS

| | | | | | |
|---|---|---|---|---|---|
| 2,621,541 | A | * | 12/1952 | Rath | 475/7 |
| 2,621,543 | A | * | 12/1952 | Rossmann | 74/625 |
| 2,621,544 | A | * | 12/1952 | Rossmann | 475/4 |
| 2,718,395 | A | * | 9/1955 | Ehrlich | 74/625 |
| 3,517,571 | A | | 6/1970 | Treber et al. | |
| 3,742,781 | A | * | 7/1973 | Boyriven | 74/625 |
| 3,821,907 | A | | 7/1974 | Habert | |
| 3,967,511 | A | * | 7/1976 | Breitschwerdt | 74/625 |
| 4,085,629 | A | * | 4/1978 | Fogarollo | 74/625 |
| 4,137,796 | A | | 2/1979 | Bostrom | |
| 4,182,078 | A | * | 1/1980 | Bartholomew | 49/140 |
| 4,257,192 | A | * | 3/1981 | Bartholomew | 49/140 |
| 4,553,656 | A | * | 11/1985 | Lense | 192/142 R |
| 4,858,489 | A | * | 8/1989 | Baynes | 74/547 |
| 5,327,990 | A | * | 7/1994 | Busquets | 180/271 |
| 5,574,315 | A | * | 11/1996 | Weber | 307/10.1 |
| 5,991,975 | A | * | 11/1999 | Baer | 16/354 |
| 6,021,691 | A | * | 2/2000 | Wilkerson, Jr. | 74/547 |
| 6,483,267 | B1 | * | 11/2002 | Jurney | 318/283 |
| 7,249,441 | B2 | * | 7/2007 | Hartle | 49/139 |
| 7,456,367 | B2 | | 11/2008 | Goff et al. | |
| 7,588,116 | B2 | * | 9/2009 | Kamiya | 180/274 |
| 7,861,460 | B1 | * | 1/2011 | Costello et al. | 49/141 |

FOREIGN PATENT DOCUMENTS

| | | |
|---|---|---|
| GB | 1154818 | 6/1969 |
| IT | 1226485 | 1/1991 |

OTHER PUBLICATIONS

Car Parts Wholesale, "Window Regulator", http://www.carpartswholesale.com/cpw/window_regulator.html, 2 pages.

* cited by examiner

*Primary Examiner* — Katherine Mitchell
*Assistant Examiner* — Justin Rephann
(74) *Attorney, Agent, or Firm* — Oblon, Spivak, McClelland, Maier & Neustadt, L.L.P.

(57) ABSTRACT

An emergency vehicle window opener that includes a power window switch that controls an electrical motor to open and to close a window of a vehicle, a retractable handle that is extended to manually open and close the window of the vehicle, a first pinion gear connected to the retractable handle, a second pinion gear that is engaged with the first pinion gear, an electrical magnet, an electrical switch, an actuator having a controller that receives an emergency signal and controls the electrical switch based on the emergency signal, a coupling part, a coupling button, and a coupling spring.

16 Claims, 13 Drawing Sheets

EMERGENCY VEHICLE WINDOW OPENER

GRANT OF NON-EXCLUSIVE RIGHT

This application was prepared with financial support from the Saudi Arabian Cultural Mission (SACM), and in consideration therefore the present inventor has granted The Kingdom of Saudi Arabia a non-exclusive right to practice the present disclosure.

BACKGROUND

Field of the Disclosure

The present disclosure relates to an emergency vehicle window opener, and more particularly, relates to an emergency vehicle window opener with a hidden retractable handle.

BRIEF SUMMARY

It is an object of this application to provide an emergency vehicle window opener that includes: a power window switch that controls an electrical motor to open and to close a window of a vehicle, a retractable handle that is extended to manually open and close the window of the vehicle, the retractable handle having a retractable handle knob to rotate the retractable handle around a crank, the crank being connected to the window such that rotating the crank causes the window to open or to close, a first pinion gear connected to the retractable handle such that the retractable handle is extended around the first pinion gear, a second pinion gear that is engaged with the first pinion gear and has a spring actuated mechanism that causes extension of the retractable handle, an electrical magnet that is connected to a power supply, the electrical magnet is on and generate magnetic fields when an electrical current from the power supply flows in the electrical magnet, and the electrical magnet is off when the electrical current from the power supply does not flow in the electrical magnet, an electrical switch that connects and disconnects the electrical current from flowing in the power supply to the electrical magnet, an actuator having a controller that receives an emergency signal and controls the electrical switch based on the emergency signal, a coupling part that is engaged with a gear of the crank to allow a rotation of the retractable handle to rotate the crank, a coupling button that causes the coupling part being engaged and disengaged with the gear of the crank, and a coupling spring that pushes the coupling part toward a position in which the coupling part is engaged with the gear of the crank.

It is an object of this application to provide an emergency vehicle window opener according to Claim 1 that further includes: an outer frame having a hole, a magnetically actuated latch that is made from a ferroelectric material, a latch spring that is connected to the magnetically actuated latch at one end and is connected to a bottom of the hole at another end, and the retractable handle further includes a latch hole such that the latch spring and the magnetically actuated latch is placed inside the latch hole, the latch spring and the magnetically actuated latch is fully contained inside the hatch hole in absence of the magnetic fields from the electrical magnet, and the first pinion gear is connected to the outer frame.

It is an object of this application to provide an emergency vehicle window opener such that the retractable handle is hidden in retracted position.

It is an object of this application to provide an emergency vehicle window opener such that the actuator, the electrical switch, and the electrical magnet is placed in the retractable handle, and the power window switch is placed on the retractable handle.

It is an object of this application to provide an emergency vehicle window opener such that when the electrical magnet is on, the magnetic fields adsorb the magnetically actuated latch and causes the magnetically actuated latch to enter the latch hole, preventing the retractable handle from being extended, and when the electrical magnet is off, the magnetic fields does not adsorb the magnetically actuated latch and causes the magnetically actuated latch to fully remain contained in the hole, allowing extension of the retractable handle.

It is an object of this application to provide an emergency vehicle window opener such that the controller receives the emergency signal and turns off the electrical switch, the controller is reset using a reset signal, the reset signal being generated by the power window switch, the reset signal causes the controller to turn the electrical switch on, and the power window switch being a four-state switch, having an open state, a close state, a no-action state, and a reset state.

It is an object of this application to provide an emergency vehicle window opener such that the reset state of the power window switch generates a pulsed-shaped signal with a duration of 1 millisecond.

It is an object of this application to provide an emergency vehicle window opener such that the reset state of the power window switch is pressed three times to reset the controller of the actuator.

It is an object of this application to provide an emergency vehicle window opener such that a power failure is the vehicle cause the retractable handle being extended.

It is an object of this application to provide an emergency vehicle window opener that includes a power window switch that controls an electrical motor to open and to close a window of a vehicle, a retractable handle that is extended to manually open and close the window of the vehicle, the retractable handle having a retractable handle knob to rotate the retractable handle around a crank, the crank being connected to the window such that rotating the crank causes the window to open or to close, a first pinion gear connected to the retractable handle such that the retractable handle is extended around the first pinion gear, a second pinion gear that is engaged with the first pinion gear and has a spring actuated mechanism that causes extension of the retractable handle, an electrical magnet that is connected to a power supply, the electrical magnet is on and generate magnetic fields when an electrical current from the power supply flows in the electrical magnet, and the electrical magnet is off when the electrical current from the power supply does not flow in the electrical magnet, an electrical switch that connects and disconnects the electrical current from flowing in the power supply to the electrical magnet, an actuator having a controller that receives an emergency signal and controls the electrical switch based on the emergency signal, a chamber having a plurality of pins that is engaged with an engagement spring base of the crank to allow a rotation of the retractable handle to rotate the crank, the engagement base of the crank having a plurality of pin holes that fit into the plurality of pins, and a engagement spring that pushes the chamber toward a position in which the plurality of pins of the chamber are engaged with the plurality of pin holes of the engagement spring base of the crank.

It is an object of this application to provide an emergency vehicle window opener that further includes: an outer frame having a hole, a magnetically actuated latch that is made from a ferroelectric material, a latch spring that is connected to the magnetically actuated latch at one end and is connected to a bottom of the hole at another end, and the retractable handle further includes a latch hole, such that the latch spring and the magnetically actuated latch is placed inside the latch hole, the latch spring and the magnetically actuated latch is fully contained inside the hatch hole in absence of the magnetic fields from the electrical magnet, and the first pinion gear is connected to the outer frame.

It is an object of this application to provide an emergency vehicle window opener such that the retractable handle is hidden in retracted position.

It is an object of this application to provide an emergency vehicle window opener such that the actuator, the electrical switch, and the electrical magnet is placed in the retractable handle, and the power window switch is placed on the retractable handle.

It is an object of this application to provide an emergency vehicle window opener such that when the electrical magnet is on, the magnetic fields adsorb the magnetically actuated latch and causes the magnetically actuated latch to enter the latch hole, preventing the retractable handle from being extended, and when the electrical magnet is off, the magnetic fields does not adsorb the magnetically actuated latch and causes the magnetically actuated latch to fully remain contained in the hole, allowing extension of the retractable handle.

It is an object of this application to provide an emergency vehicle window opener such that the controller receives the emergency signal and turns off the electrical switch, the controller is reset using a reset signal, the reset signal being generated by the power window switch, the reset signal causes the controller to turn the electrical switch on, and the power window switch being a four-state switch, having an open state, a close state, a no-action state, and a reset state.

It is an object of this application to provide an emergency vehicle window opener such that the reset state of the power window switch generates a pulsed-shaped signal with a duration of 1 millisecond.

It is an object of this application to provide an emergency vehicle window opener such that the reset state of the power window switch is pressed three times to reset the controller of the actuator.

It is an object of this application to provide an emergency vehicle window opener such that a power failure is the vehicle cause the retractable handle being extended.

DETAILED DESCRIPTION

Figure 1:
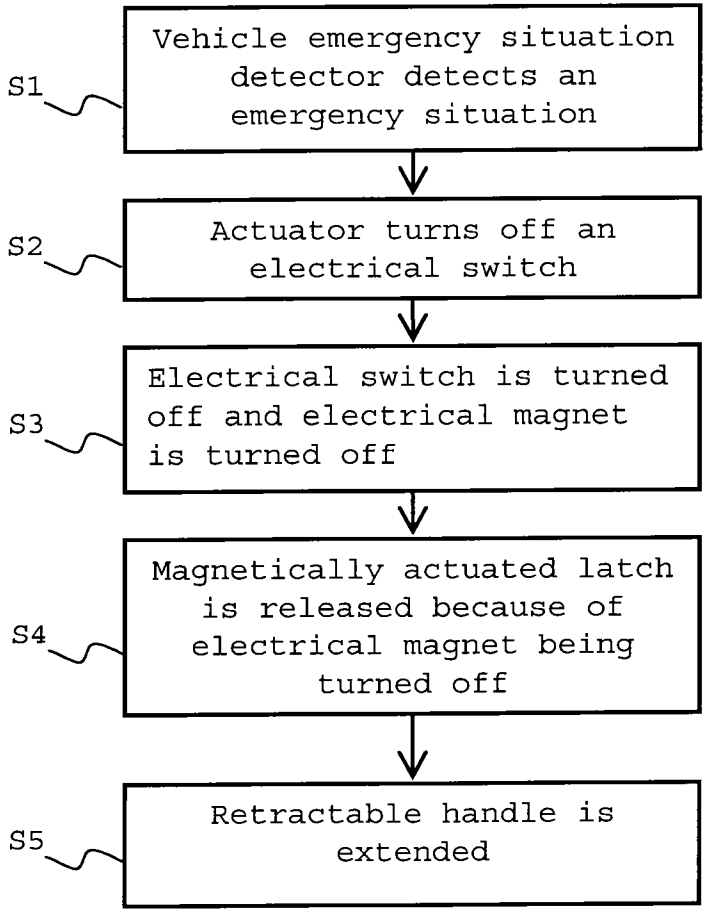
FIG. 1 is a process flow chart of an emergency vehicle window opener in accordance with present application.

FIG. 1 is a process flow chart of an exemplary emergency vehicle window opener. At S1, a vehicle emergency situation detector detects an emergency situation. The vehicle emergency situation detector generates a signal indicating an emergency situation. Examples of emergency situation include, but are not limited to, engine fire, collision, being stuck or sinking in flood or water, and a vehicle's electrical power failure. In an emergency situation, passengers of a vehicle can manually open a power window of the vehicle using a retractable handle to exit the vehicle as soon as possible. In normal operation, electrical power causes a rotating motor to open (roll down) or close (roll up) the window when a power window switch is pressed.

At S2, an actuator of the emergency vehicle window opener receives an emergency signal from the vehicle emergency situation detector regarding an emergency situation. The actuator then turns off an electrical switch of the emergency vehicle window opener. The electrical switch is a switch that controls electrical power of an electrical magnet that generates a magnetic field.

At S3, the electrical power of the electrical magnet is turned off. As a result, the magnetic field of the electrical magnet disappears. When the electrical power of the electrical magnet is on, the magnetic field of the electrical magnet attracts a magnetically actuated latch of the retractable handle engaged with a latch hole and places the retractable handle in a locked position. Therefore, prevents the retractable handle from being extended. In other words, presence of the magnetic field in the electrical magnet prevents the retractable handle from being extended. As such, in the absence of the magnetic field, the retractable handle is extended. It should be noted that the retractable handle in the retracted position is hidden and is not accessible to passengers under normal operation.

At S4, the magnetically actuated latch is released from the latch hole because the electrical magnet is turned off and no magnetic field exists. As a result, the magnetically actuated latch spring pushes back the magnetically actuated latch as the electrical magnet does not adsorb or attract the magnetically actuated latch, and places the retractable handle 33 in an unlocked position.

At S5, the retractable handle is extended. The retractable handle can be used to manually open and close the window in an emergency situation.

Figure 2:
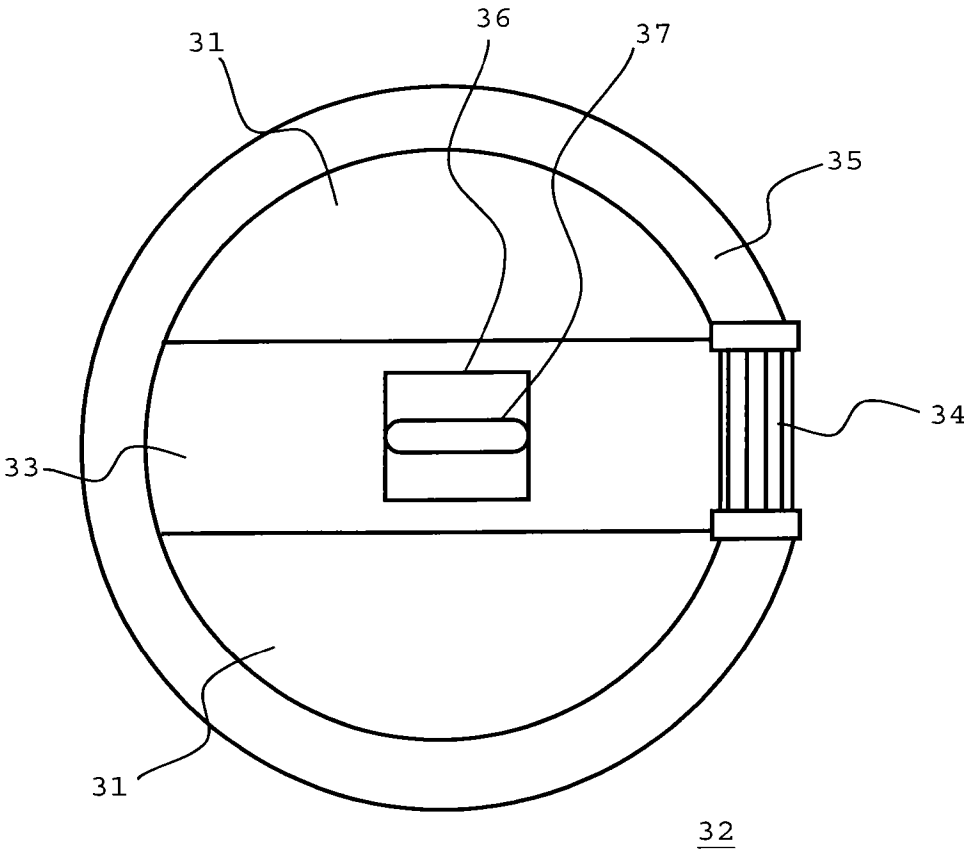
FIG. 2 is a plan view of an emergency vehicle window opener with a retractable handle in a retracted position in accordance with present application.

FIG. 2 is a plan view of an exemplary embodiment of an emergency vehicle window opener 32 with a retractable handle 33 such that the retractable handle 33 is in a retracted position. When in retracted position, the retractable handle 33 is hidden. The retractable handle 33 can be extended around a first pinion gear 34. The retractable handle 33 may be connected to the first pinion gear 34 directly as shown in FIG. 2, or may be connected to the first pinion gear 34 using a hinge or a connector (not shown). A power window switch 37 and an power window switch frame 36 can be constructed on the retractable handle 33. The power window switch 37 is a switch that is used to electrically open and close a vehicle's window in normal operation, i.e., when an emergency situation is not detected. The power window switch 37 may have at least three states: an open state, a close state, and a no-action state. The power window switch 37 by default is on the no-action state and switching the power window switch 37 to the open state or the close state results in an electrical motor to open and close the window, respectively. The retractable handle 33 and the first pinion gear 34 are constructed on an outer frame 35, an inner frame 31, and a bottom frame 43. The outer frame 35, the inner frame 31, are constructed on the bottom frame 43. Alternatively, the power window switch 37 can be constructed on the inner frame 31.

Figure 3:
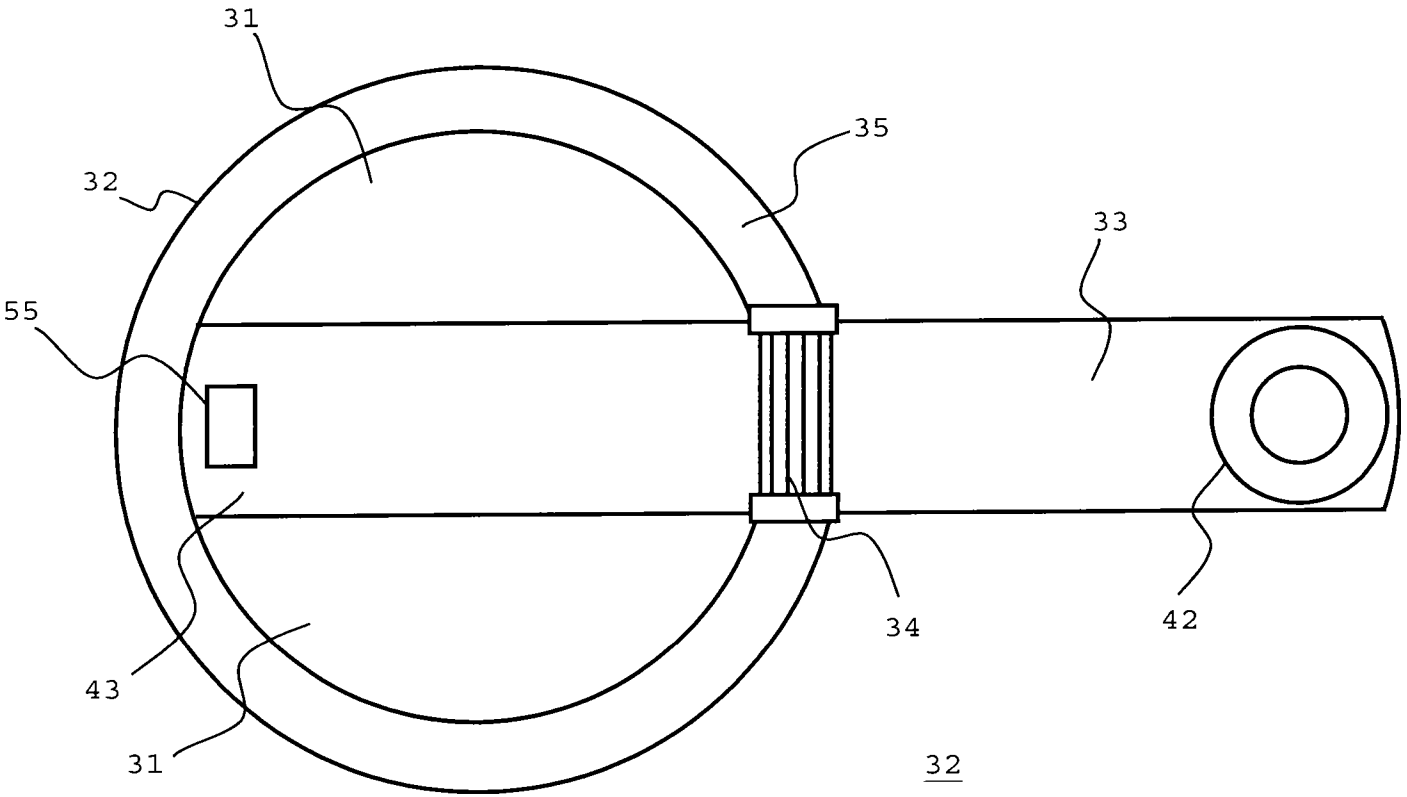
FIG. 3 is a plan view of an emergency vehicle window opener with a retractable handle in an extended position in accordance with present application.

FIG. 3 is a plan view of the emergency vehicle window opener 32 with the retractable handle 33 in an extended position when the retractable handle 33 is extended. A retractable handle knob 42 is connected to the retractable handle 33 so that the retractable handle 33 can be rotated around an axis of a crank 57 using the retractable handle knob 42. The retractable handle knob 42 can be rotated freely around an axis where the retractable handle knob 42 is connected to the retractable handle 33. When the retractable handle 33 is in the retracted position, the retractable handle knob 42 presses a coupling button 55. When the retractable handle 33 is in the extended position, the coupling button 55 is released. The coupling button 55 mechanically engages a rotation of the emergency vehicle window opener 32 to a rotation of the crank 57 when the retractable handle 33 is extended. In normal operation, i.e. when the retractable handle 33 is retracted, the emergency vehicle window opener 32 is not mechanically engaged with the crank 57.

Figure 4:
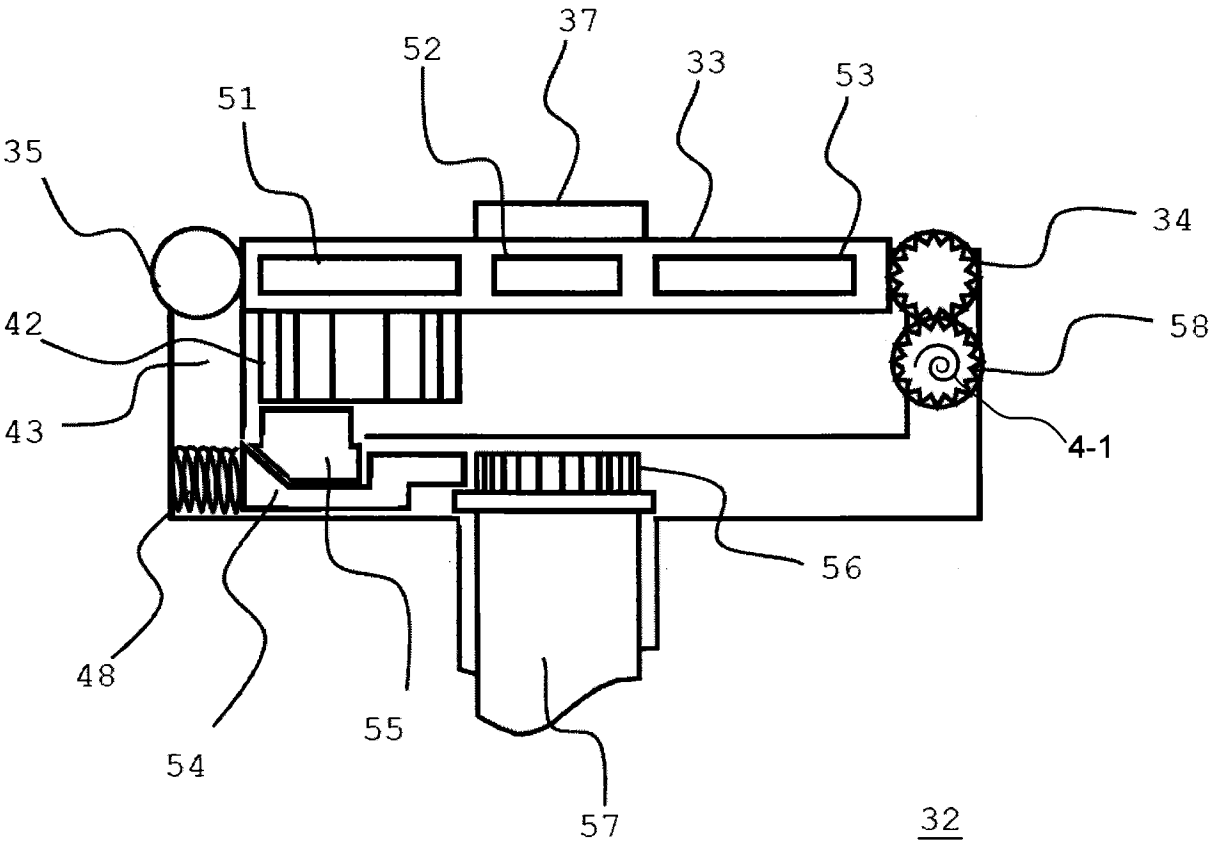
FIG. 4 is a side cross-sectional view of an emergency vehicle window opener with a retractable handle in a retracted position in accordance with present application.

FIG. 4 is a cross-sectional side view of the emergency vehicle window opener 32 with the retractable handle 33 when the retractable handle 33 is in the retracted position. The retractable handle 33 includes an electrical magnet 51, an electrical switch 52, and an actuator 53. The actuator 53 can receive a signal, for example, from an emergency situation detector that indicates existence of an emergency situation. Upon receiving the signal, the actuator 53 turns off the electrical switch 52. The electrical switch 52 controls the flow of electrical current/voltage to the electrical magnet 51. When the electrical switch 52 is turned off, the electrical magnet 51 is turned off. Turning off the electrical magnet 51 results in the retractable handle 33 getting unlocked and being extended to provide an access to the retractable handle 33 for passengers and/or a driver inside a vehicle to manually open or close the window. It should be noted that in this exemplary embodiment, deactivation of the electrical magnet 51 results in extension of the retractable handle 33, providing an advantage of the retractable handle 33 being extended in case of any electrical current/voltage failure. In other words, any power failure in the emergency vehicle window opener 32 results in the retractable handle 33 being extended. A more detailed description for retraction mechanism of the retractable handle 33 is provided later in this application.

In the normal operation, i.e. when an emergency situation is not detected, the retractable handle 33 remains locked in the retracted position. As a result, the coupling button 55 is pressed by the retractable handle knob 42. When the coupling button 55 is pressed, the coupling button 55 prevents a coupling part 54 from being engaged with a crank gear 56 of the crank 57. A coupling spring 48 pushes the coupling part 54 towards the crank gear 56. The coupling spring 48 can be replaced by elastic mechanisms that have similar functionality.

The first pinion gear 34 is connected to a second pinion gear 58. The second pinion gear 58 have a spring mechanism (4-1), for example, a torsion spring mechanism or a spiral torsion spring, which generates a rotational torque and forces the first pinion gear 34 to rotate in a direction that extends the retractable handle 33. In other words, the second pinion gear 58 always generates a force to extend the retractable handle 33. An extension speed of the retractable handle 33 may be controlled by changing the parameters of the spring mechanism of the second pinion gear 58, and the characteristics of the first pinion gear 34 and the second pinion gear 58. A counter clock-wise rotation of the second pinion gear 58 results in a clock-wise rotation of the first pinion gear 34. The clock-wise rotation of the first pinion gear 34 results in the retractable handle 33 being extended.

Figure 5:
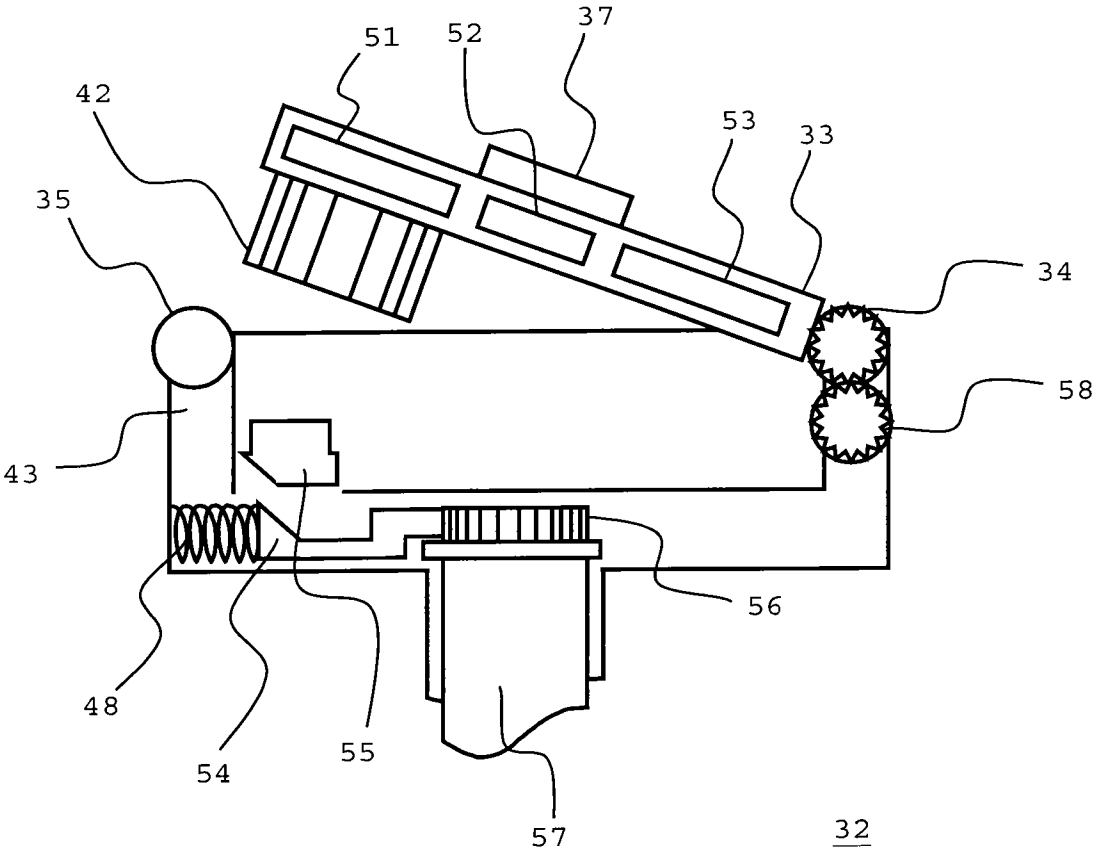
FIG. 5 is a side cross-sectional view of an emergency vehicle window opener with a retractable handle in a partially extended position in accordance with present application.

FIG. 5 is a cross-sectional side view of the emergency vehicle window opener 32 when the retractable handle 33 is in a partially extended position. When the retractable handle 33 is unlocked, the retractable handle 33 is automatically extended around the first pinion gear 34 because of a torque or a rotational force of the spring mechanism of the second pinion gear 58. As a result, when the retractable handle knob 42 no longer presses the coupling button 55, the coupling button 55 is released because of a force that the coupling spring 48 provides to the coupling part 54, which pushes up the coupling button 55. In other words, the retractable handle knob 42 prevent the coupling button 55 from being pushed up by a force that the coupling spring 48 provides to the coupling part 54. The coupling part 54 and the coupling button 55 both have a tilted surface that can fit into each other as shown in FIG. 5. The tilted surface may be greased. When the retractable handle knob 42 does not prevent the coupling button 55 from moving up, the coupling part 54 pushes up the coupling button 55. Similarly, fully retracting the retractable handle 33 results in retractable handle knob 42 to push the coupling button back inside, forcing the coupling part 54 getting disconnected from the crank gear 56.

Figure 6:
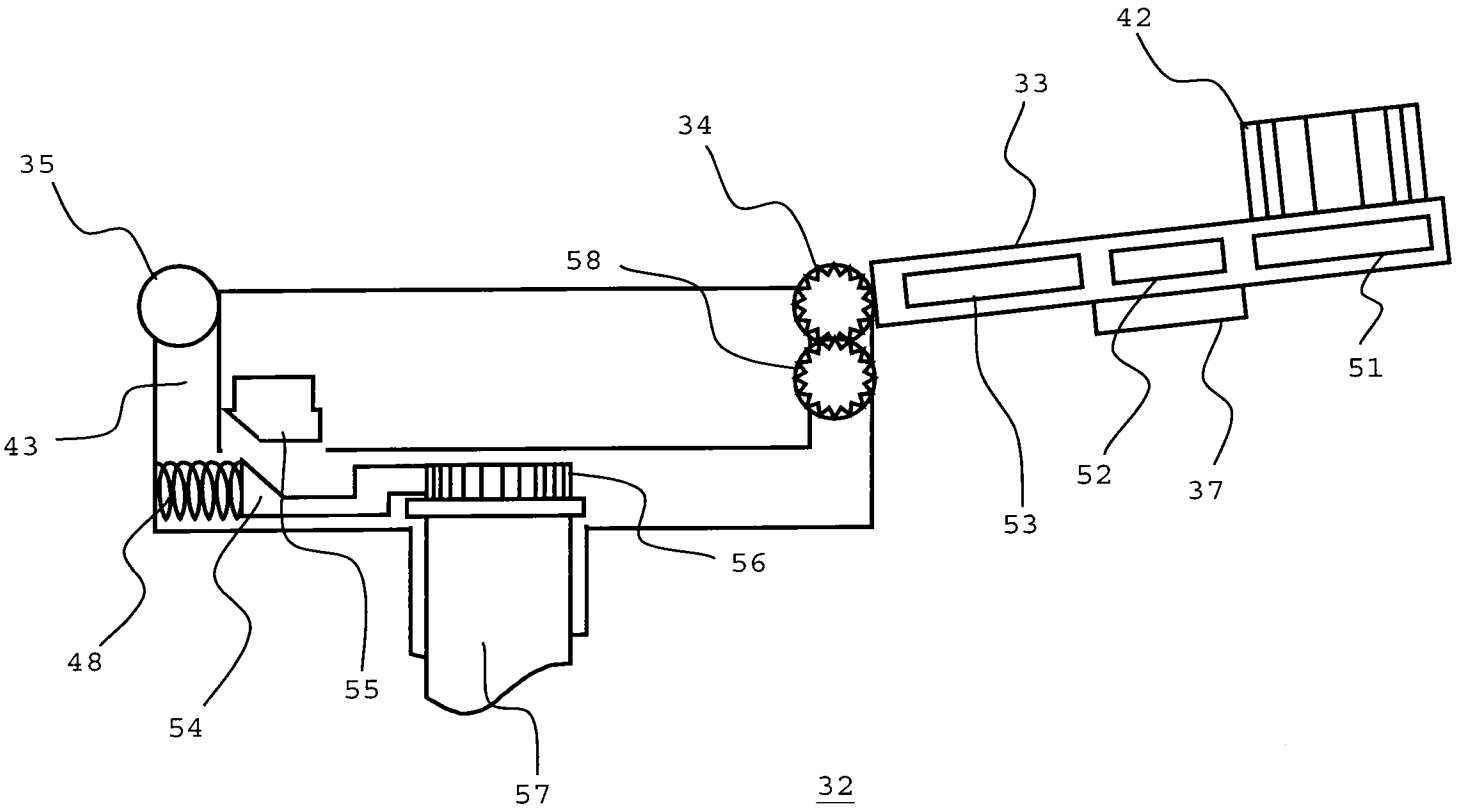
FIG. 6 is a side cross-sectional view of an emergency vehicle window opener with a retractable handle in an extended position in accordance with present application.

FIG. 6 is a cross-sectional side view of the emergency vehicle window opener 32 when the retractable handle 33 is in a fully extended position. When the retractable handle 33 is in the fully extended position, it can be rotated around the crank 57 using the retractable handle knob 42. In this case, a rotation of the retractable handle 33 results in a rotation of the bottom frame 43 of the emergency vehicle window opener 32. Because the coupling part 54 is engaged with the crank gear 56 in the fully retracted position, rotating the retractable handle 33 using the retractable handle knob 42 results in rotation of the crank 57. As such, a rotation of the crank 57 results in the window, which is connected to the crank 57, being manually opened or closed.

Figure 7:
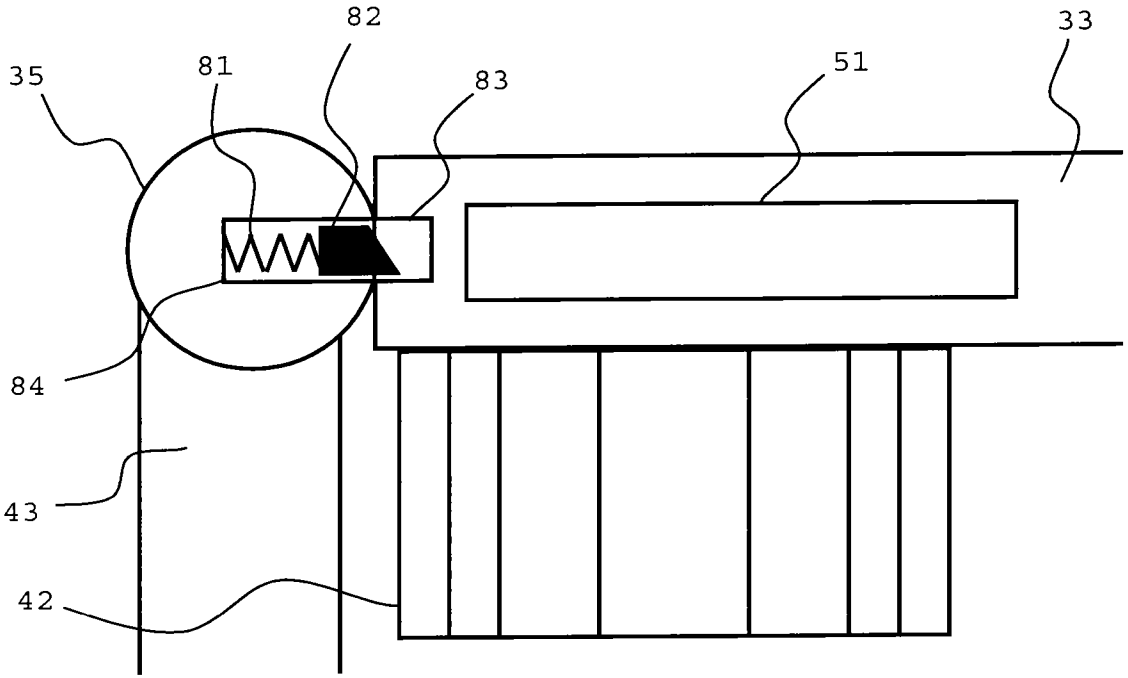
FIG. 7 is a side cross-sectional and close-up view of an emergency vehicle window opener with a magnetically actuated latch in a retracted and locked position where the magnetically actuated latch is engaged with a retractable handle in accordance with present application.

FIG. 7 is a side cross-sectional and close-up view of the emergency vehicle window opener 32 with a magnetically actuated latch 82 in the retracted and locked position when the magnetically actuated latch 82 is engaged with the retractable handle 33. The magnetically actuated latch 82 is connected to a latch spring 81. The magnetically actuated latch 82 and the latch spring 81 are placed in a hole 84 in the outer frame 35 as shown in FIG. 7. The latch spring 81 is connected to an end of the hole 84 on one end, and to the magnetically actuated latch 82 on the other end.

The magnetically actuated latch 82 is made from a ferromagnetic material. Examples of ferromagnetic materials, include but are not limited to, iron, nickel, cobalt, and their alloys. Additionally, the electrical magnet 51 is made from a type of magnet for which the magnetic field is generated by the flow of electric current and the magnetic field disappears when the current is turned off. A power supply, supplies the electrical power required for operation of the actuator and the electrical magnet. The power supply can be a battery of a vehicle that supplies the electrical power for the vehicle's operation, or can be an auxiliary battery placed in the vehicle.

When the electrical magnet 51 is activated by electrical current, the electrical magnet 51 generates magnetic fields. As a result, the magnetically actuated latch 82 gets attracted or adsorbed to the electrical magnet 51 having the magnetic fields. In this case, the magnetically actuated latch 82 penetrates into a latch hole 83 of the retractable handle 33 because the magnetic fields of the electrical magnet 51 attract or adsorbs the magnetically actuated latch 82 towards the electrical magnet 51. Therefore, when the magnetic fields of the electrical magnet 51 is on, the magnetically actuated latch 82 is engaged with the retractable handle 33 and prevents the extension of the retractable handle 33. It should be noted that in the absence of any magnetic filed, the latch spring 81 fully pull back the magnetically actuated latch 82 and places the magnetically actuated latch 82 inside the hole 84.

Figure 8:
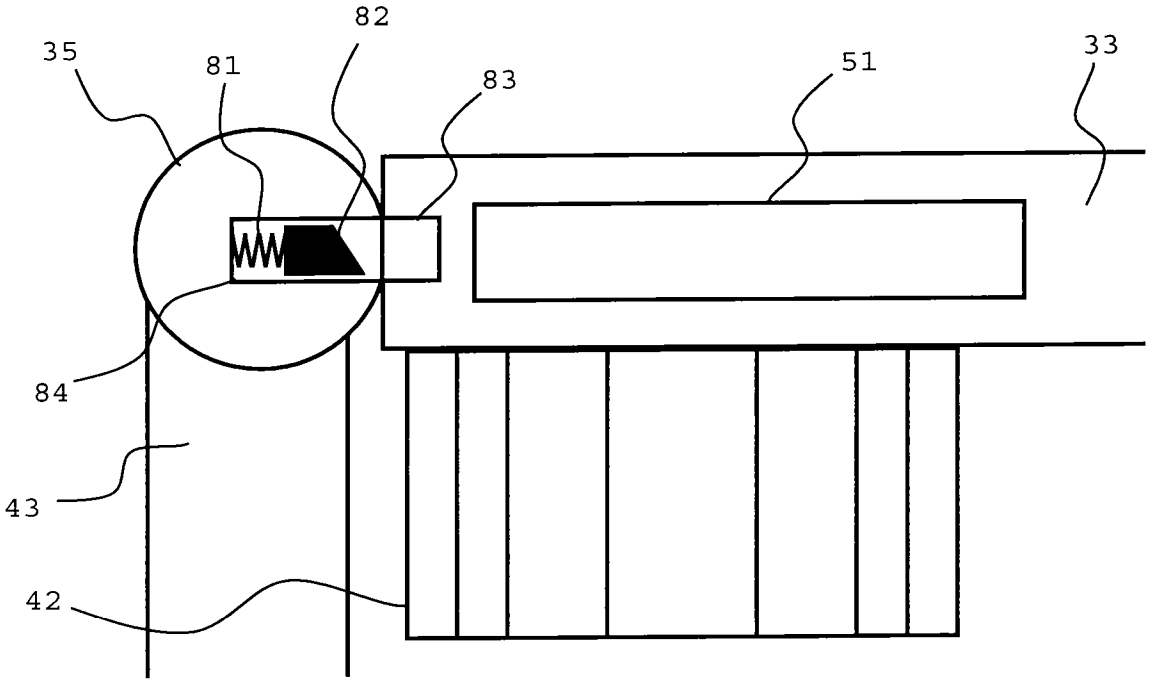
FIG. 8 is a side cross-sectional and close-up view of an emergency vehicle window opener with a magnetically actuated latch in a retracted and unlocked position where the magnetically actuated latch is not engaged with a retractable handle in accordance with present application.

FIG. 8 is a side cross-sectional and close-up view of the emergency vehicle window opener 32 with the magnetically actuated latch 82 in the retracted and unlocked position when the magnetically actuated latch 82 is disengaged from the retractable handle 33. In this case, the magnetic field of the electrical magnet 51 is off. Therefore, the latch spring 81 pulls the magnetically actuated latch 82 back. When the magnetically actuated latch 82 is pulled back by the latch spring 81, the magnetically actuated latch 82 is not engaged with the latch hole 83 of the retractable handle 33. Therefore, the retractable handle 33 is extended because of the torque or the rotational force of the spring mechanism of the second pinion gear 58 that tends to always extend the retractable handle 33.

Figure 9:
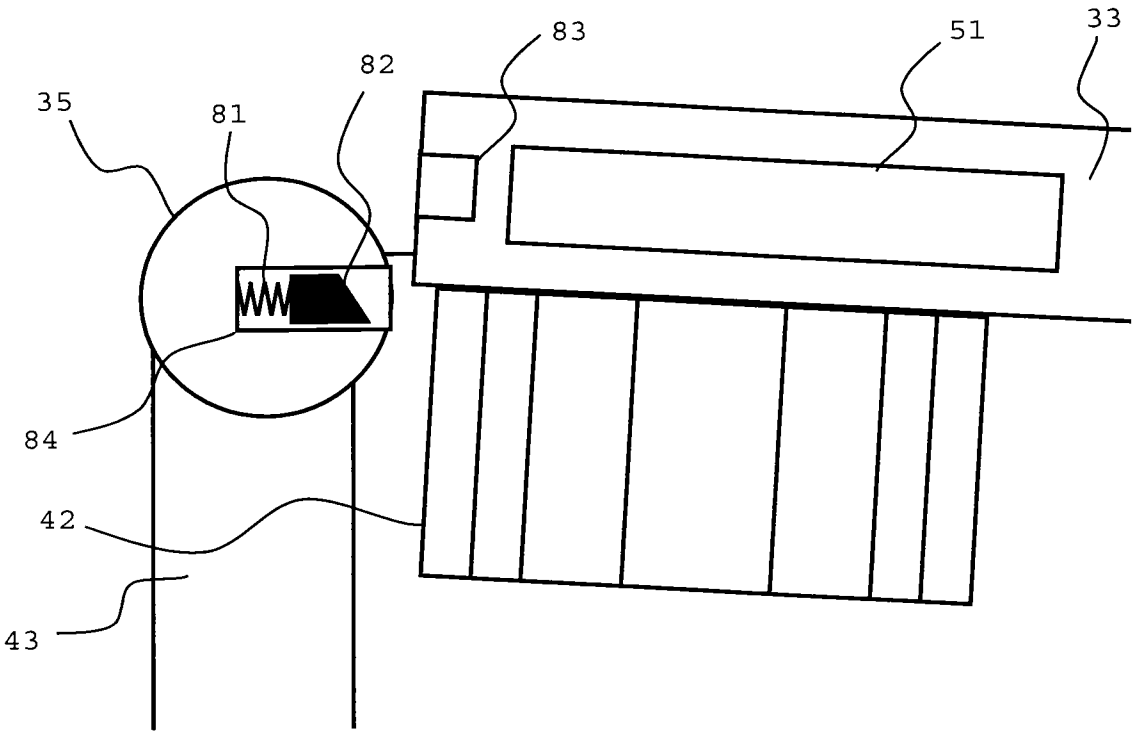
FIG. 9 is a side cross-sectional and close-up view of an emergency vehicle window opener with a magnetically actuated latch in a partially extended position where the magnetically actuated latch is not engaged with a retractable handle in accordance with present application.

FIG. 9 is a side cross-sectional and close-up view of the emergency vehicle window opener 32 with the magnetically actuated latch 82 in the partially extended and unlocked position when the magnetically actuated latch 82 is not engaged with the retractable handle 33. When the magnetic fields of the electrical magnet 51 are off, the latch spring 81 pulls back the magnetically actuated latch 82. Therefore, the spring mechanism of the second pinion gear 58 extends the retractable handle 33 because the magnetically actuated latch 82 is not engaged with the latch hole 83 of the retractable handle 33.

In order to retract and lock the retractable handle 33 that has been extended, a passenger may force the retractable handle 33 back to the retracted position. In this case, the electrical magnet must be activated or turned on to enable the magnetically actuated latch 82 to lock the retractable handle 33 in the retracted position. When the retractable handle 33 is placed in the retracted position and the electrical magnet 51 is activated, the magnetic fields of the electrical magnet 51 attract or adsorb the magnetically actuated latch 82. In this case, the magnetically actuated latch 82 gets engaged with the latch hole 83 and the retractable handle 33 is locked in the retracted position. The retractable handle 33 can be extended again by deactivating or turning off the electrical magnet 51.

Figure 10:
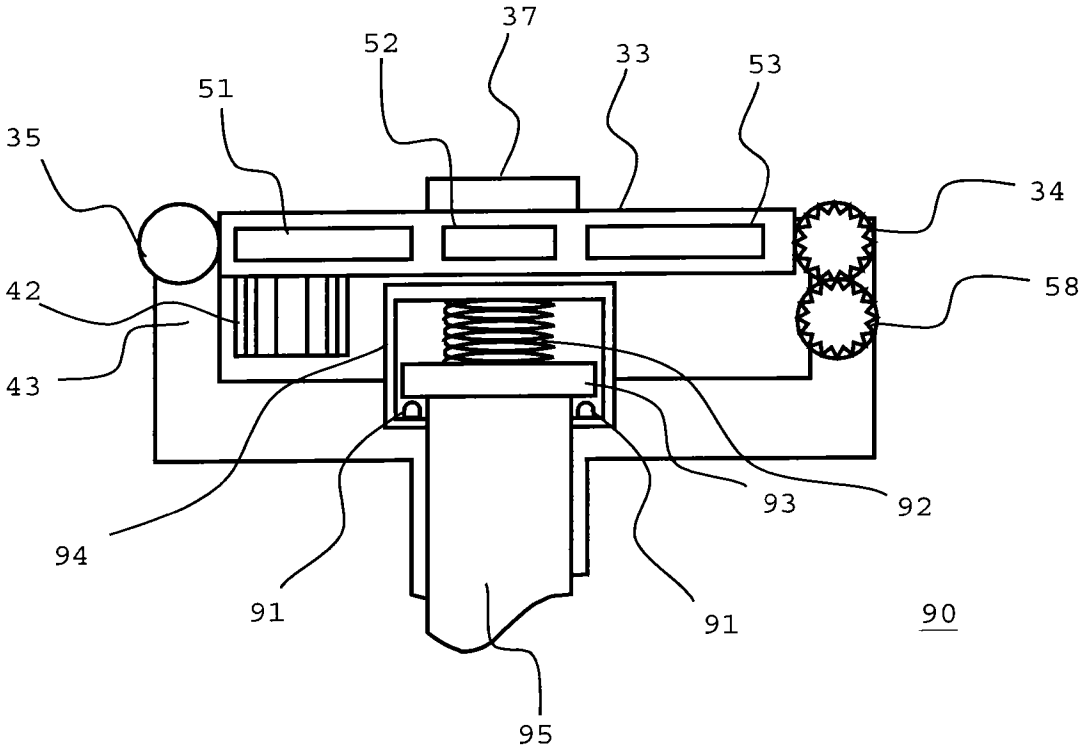
FIG. 10 is a plan view of another embodiment of an emergency vehicle window opener with a retractable handle in a retracted position in accordance with present application.

FIG. 10 is a cross-sectional side view of another embodiment of an emergency vehicle window opener 90 with a retractable handle 33 in a retracted position. In this embodiment, the bottom frame 43 can be engaged with a crank 95 via a chamber 94 and a plurality of pins 91 such that in an inner portion of the chamber 94, the plurality of pins 91 are attached or assembled. A rotation of the chamber 94 is fixed to a rotation of the bottom frame 43. The chamber is movable back and forth axially in the bottom frame 43 along a predetermined path having a predetermined distance that is required for connecting and disconnecting the plurality of pins 91. The crank 95 has an engagement spring base 93 at one end, which has a plurality of holes to be engaged with the plurality of pins 91 as shown in FIG. 10. Additionally, the engagement spring base 93 provides a base so that an engagement spring 92 can be placed in between the engagement spring base 93 and the chamber 94. In this preferred embodiment, when the retractable handle 33 is in the retracted position, the retractable handle 33 pushes down the chamber 94 and releases the plurality of pins 91 from being engaged with the engagement spring base 93. It should be noted that the remaining components and parts of the emergency vehicle window opener 90 are described previously in the other preferred embodiment in this application.

Figure 11:
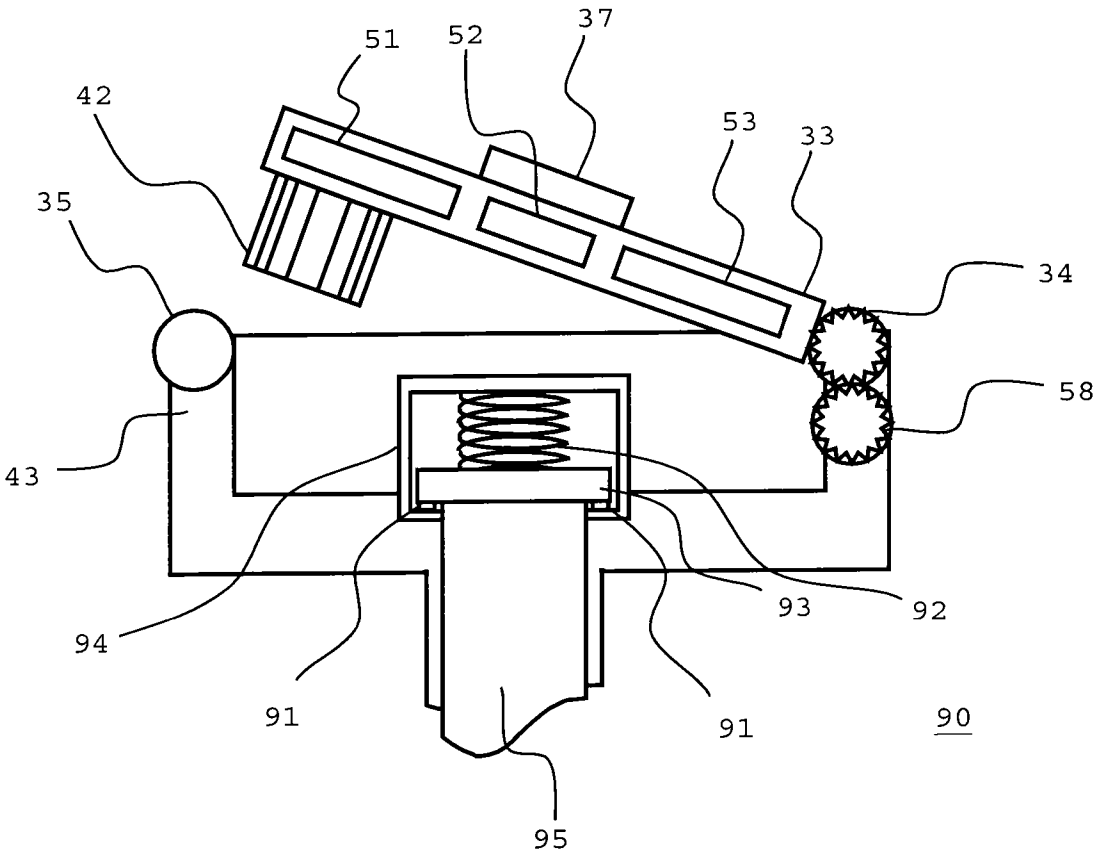
FIG. 11 is a plan view of another embodiment of an emergency vehicle window opener with a retractable handle in a partially extended position in accordance with present application.
Figure 12:
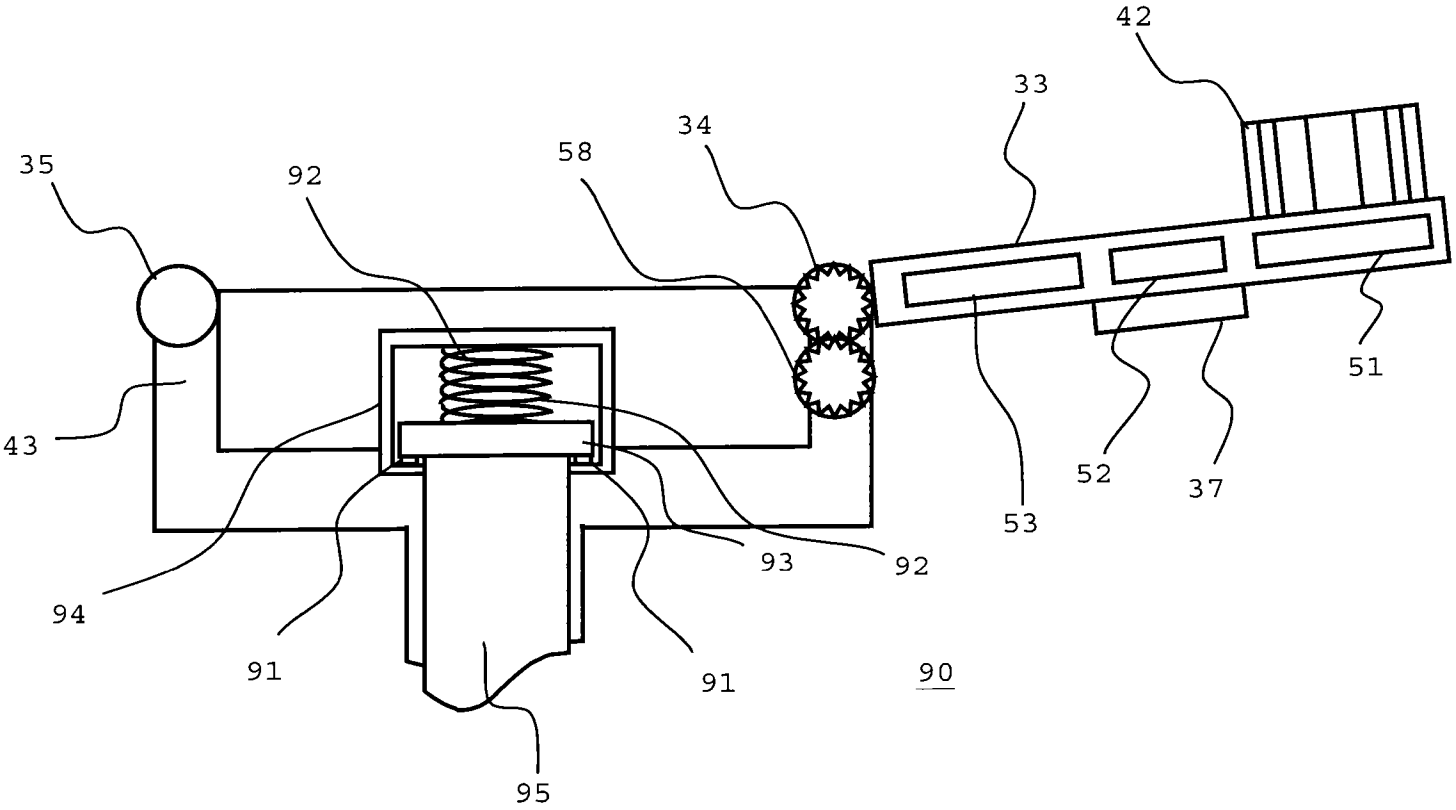
FIG. 12 is a plan view of another embodiment of an emergency vehicle window opener with a retractable handle in an extended position in accordance with present application.

FIG. 11 and FIG. 12 are cross-sectional side views of another embodiment of an emergency vehicle window opener 90 with a retractable handle 33 in a partially extended and fully extended positions, respectively. When the retractable handle 33 is extended, the engagement spring 92 pushes up the chamber 92, and the chamber 92 moves up freely because the retractable handle 33 does not prevent the movement of the chamber 92. As a result, the plurality of pins 91 get engaged with the plurality of holes in the engagement spring base 93. Therefore, rotation of the bottom frame 43 of the emergency vehicle window opener 90 gets locked to rotation of the crank 95. In this position, where the retractable handle 33 is extended, rotating the emergency vehicle window opener 90 using the retractable handle knob 42 results in rotation of the crank 95, which is connected to the vehicle's window. Therefore, the vehicle's window can be manually opened or closed using the emergency vehicle window opener 90.

Similarly, retracting the retractable handle 33 that is extended results in pressing the engagement spring 92 and disengaging or disconnecting the plurality of the pins 91 from the engagement spring base 93. In this case, rotating the emergency vehicle window opener 90 does not rotate the crank 95. It should be noted release mechanism for the retractable handles 33 in FIGS. 10-12 are similar to those described in FIGS. 7-9.

Figure 13:
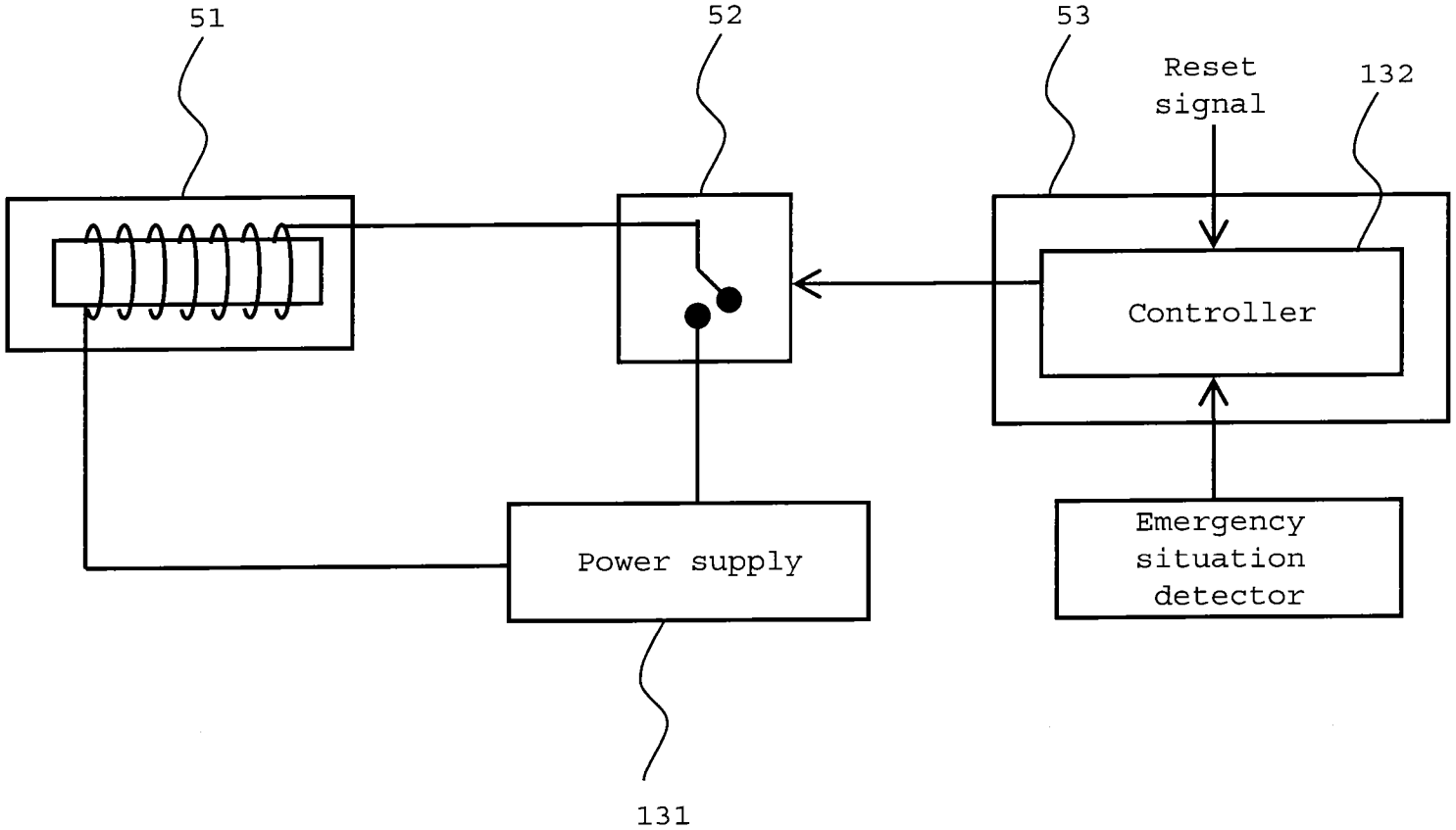
FIG. 13 is a block diagram of an actuator, an electrical switch, and an electrical magnet of the emergency vehicle window opener.

FIG. 13 is a block diagram of an actuator, an electrical switch, and an electrical magnet of the emergency vehicle window opener. The electrical switch 53 can be controlled by a controller 132 of the actuator 53. The actuator 53 includes a controller 1302 that receives the emergency signal, a reset signal. The controller 132 can switch the electrical switch 52 on and off. In normal operation, the electrical switch 52 is in a "connected" or "on" position, i.e. the power supply 131 supplies power to the electrical magnet 51. When the emergency situation detector detects an emergency situation, it generates an emergency signal for the controller 132 of the actuator 53 that indicates an emergency situation. When the controller 132 receives the emergency signal, the controller 132 turns off the electrical switch 51 permanently until the reset signal is received by the controller 132. The shape and duration of the emergency signal can be of any shape, duration, or form, for example it can be an electrical pulse with duration of 1, 10, 100 microseconds, or 1, 10, or 100 millisecond. It should be noted that the emergency signal may trigger the controller 132 on a raising edge or the falling edge of the emergency signal. When the controller 132 is triggered once, the controller needs to be reset in order to be triggered again. In other words, in order to increase the reliability of the operation, any change in the emergency signal would trigger the controller 132. Once triggered, the controller 132 disconnects the electrical switch 51. As a result, the electrical magnet 51 gets disconnected and the retractable handle 33 gets extended.

When an extended retractable handle 33 needs to be placed back in the retracted position (hidden position) and locked after an emergency situation has passed, the controller 132 may need to be reset using the reset signal. The reset signal may be generated by the power window switch 37 or any additional switch. For example, the power window switch 37 may be a four-state switch, i.e., may have four states: an open state, a close state, a no-action state, and a reset state. Additionally, the controller 132 may be programmed to be reset with a specific pattern for the reset signal is achieved in order to prevent accidental reset of the controller 132. For example, the controller 132 may be programmed to connect the electrical switch 53 when the reset signal is pressed two, three or four time, or any predetermined pattern. Alternatively, the controller 132 may be programmed to connect the electrical switch 53 when the reset signal is pressed and hold for more than a certain duration of time, for example, more than three, five, or ten seconds.

Although the foregoing description is directed to the preferred embodiments, it is noted that other variations and modifications will be apparent to those skilled in the art, and may be made without departing from the spirit or scope of this application. Moreover, features described in connection with one embodiment of the invention may be used in conjunction with other embodiments, even if not explicitly stated above.

The invention claimed is:

1. An emergency vehicle window opener, comprising:

a power window switch that controls an electrical motor to open and to close a window of a vehicle;

a retractable handle that is extended to manually open and close said window of said vehicle, said retractable handle having a retractable handle knob to rotate said retractable handle around a crank, said crank being connected to said window such that rotating said crank causes said window to open or to close;

a first pinion gear connected to said retractable handle such that said retractable handle is extended around said first pinion gear;

a second pinion gear that is engaged with said first pinion gear and has a spring actuated mechanism that causes extension of said retractable handle;

an electrical magnet that is connected to a power supply, said electrical magnet generates magnetic fields when an electrical current from said power supply flows in said electrical magnet, and said electrical magnet is off when said electrical current from said power supply does not flow in said electrical magnet;

an electrical switch that connects and disconnects said electrical current from flowing in said power supply to said electrical magnet;

an actuator having a controller that receives an emergency signal and controls said electrical switch based on said emergency signal;

a coupling part that is engaged with a gear of said crank to allow a rotation of said retractable handle to rotate said crank;

a coupling button that causes said coupling part being engaged and disengaged with said gear of said crank; and a coupling spring that pushes said coupling part toward a position in which said coupling part is engaged with said gear of said crank, wherein said actuator, said electrical switch, and said electrical magnet is placed in said retractable handle, and said power window switch is placed on said retractable handle.

2. The emergency vehicle window opener according to claim 1, further comprising:

an outer frame having a hole;

a magnetically actuated latch that is made from a ferroelectric material;

a latch spring that is connected to said magnetically actuated latch at one end and is connected to a bottom of said hole at another end; and said retractable handle further includes a latch hole, wherein said latch spring and said magnetically actuated latch is placed inside said latch hole, said latch spring and said magnetically actuated latch is fully contained inside said hatch hole in absence of said magnetic fields from said electrical magnet, and said first pinion gear is connected to said outer frame.

3. The emergency vehicle window opener according to claim 2, wherein when said electrical magnet is on, said magnetic fields adsorb said magnetically actuated latch and causes said magnetically actuated latch to enter said latch hole, preventing said retractable handle from being extended, and when said electrical magnet is off, said magnetic fields does not adsorb said magnetically actuated latch and causes said magnetically actuated latch to fully remain contained in said hole, allowing extension of said retractable handle.

4. The emergency vehicle window opener according to claim 3, wherein said controller receives said emergency signal and turns off said electrical switch, said controller is reset using a reset signal, said reset signal being generated by said power window switch, said reset signal causes said controller to turn said electrical switch on, and said power window switch being a four-state switch, having an open state, a close state, a no-action state, and a reset state.

5. The emergency vehicle window opener according to claim 4, wherein said reset state of said power window switch generates a pulsed-shaped signal with a duration of 1 millisecond.

6. The emergency vehicle window opener according to claim 4, wherein said reset state of said power window switch is pressed three times to reset said controller of said actuator to place the retractable handle in a retracted locked position.

7. The emergency vehicle window opener according to claim 4, wherein a power failure is said vehicle cause said retractable handle being automatically extended.

8. The emergency vehicle window opener according to claim 1, wherein said retractable handle is hidden in retracted position.

9. An emergency vehicle window opener, comprising:

a power window switch that controls an electrical motor to open and to close a window of a vehicle;

a retractable handle that is extended to manually open and close said window of said vehicle, said retractable handle having a retractable handle knob to rotate said retractable handle around a crank, said crank being connected to said window such that rotating said crank causes said window to open or to close;

a first pinion gear connected to said retractable handle such that said retractable handle is extended around said first pinion gear;

a second pinion gear that is engaged with said first pinion gear and has a spring actuated mechanism that causes extension of said retractable handle;

an electrical magnet that is connected to a power supply, said electrical magnet generates magnetic fields when an electrical current from said power supply flows in said electrical magnet, and said electrical magnet is off when said electrical current from said power supply does not flow in said electrical magnet;

an electrical switch that connects and disconnects said electrical current from flowing in said power supply to said electrical magnet;

an actuator having a controller that receives an emergency signal and controls said electrical switch based on said emergency signal;

a coupling part that is engaged with a gear of said crank to allow a rotation of said retractable handle to rotate said crank;

a coupling button that causes said coupling part being engaged and disengaged with said gear of said crank;

a coupling spring that pushes said coupling part toward a position in which said coupling part is engaged with said gear of said crank;

an outer frame having a hole;

a magnetically actuated latch that is made from a ferroelectric material;

a latch spring that is connected to said magnetically actuated latch at one end and is connected to a bottom of said hole at another end;

said retractable handle further includes a latch hole, wherein said latch spring and said magnetically actuated latch is placed inside said latch hole, said latch spring and said magnetically actuated latch is fully contained inside said hatch hole in absence of said magnetic fields from said electrical magnet, and said first pinion gear is connected to said outer frame.

10. The emergency vehicle window opener according to claim 9, wherein said retractable handle is hidden in retracted position.

11. The emergency vehicle window opener according to claim 9, wherein said actuator, said electrical switch, and said electrical magnet is placed in said retractable handle, and said power window switch is placed on said retractable handle.

12. The emergency vehicle window opener according to claim 9, wherein when said electrical magnet is on, said magnetic fields adsorb said magnetically actuated latch and causes said magnetically actuated latch to enter said latch hole, preventing said retractable handle from being extended, and when said electrical magnet is off, said magnetic fields does not adsorb said magnetically actuated latch and causes said magnetically actuated latch to fully remain contained in said hole, allowing extension of said retractable handle.

13. The emergency vehicle window opener according to claim 12, wherein said controller receives said emergency signal and turns off said electrical switch, said controller is reset using a reset signal, said reset signal being generated by said power window switch, said reset signal causes said controller to turn said electrical switch on, and said power window switch being a four-state switch, having an open state, a close state, a no-action state, and a reset state.

14. The emergency vehicle window opener according to claim 13, wherein said reset state of said power window switch generates a pulsed-shaped signal with a duration of 1 millisecond.

15. The emergency vehicle window opener according to claim 13, wherein said reset state of said power window switch is pressed three times to reset said controller of said actuator to place the retractable handle in a retracted locked position.

16. The emergency vehicle window opener according to claim 13, wherein a power failure is said vehicle cause said retractable handle being automatically extended.

* * * * *